United States Patent [19]

Kursar

[11] Patent Number: 5,025,830

[45] Date of Patent: Jun. 25, 1991

[54] VALVE UNLOADER FINGER ASSEMBLY, A METHOD OF FORMING THE SAME, A KIT, AND A PLATE THEREFOR

[75] Inventor: James V. Kursar, Painted Post, N.Y.

[73] Assignee: Dresser-Rand Company, Corning, N.Y.

[21] Appl. No.: 568,436

[22] Filed: Aug. 16, 1990

[51] Int. Cl.[5] ..... F16K 15/18

[52] U.S. Cl. ..... 137/522; 29/890.13; 417/298

[58] Field of Search ..... 137/522, 523; 417/297, 417/298; 29/890.13

[56] References Cited

U.S. PATENT DOCUMENTS

| | | | |
|---|---|---|---|
| 1,122,395 | 12/1914 | Iversen | 417/298 |
| 4,869,289 | 9/1989 | Hrabal | 417/298 X |

FOREIGN PATENT DOCUMENTS

| | | | |
|---|---|---|---|
| 167371 | 6/1950 | Austria | 137/516.11 |
| 51598 | 8/1911 | Fed. Rep. of Germany | 417/298 |
| 326039 | 4/1935 | Italy | 417/298 |
| 245979 | 1/1926 | United Kingdom | 417/298 |

*Primary Examiner*—Robert G. Nilson

*Attorney, Agent, or Firm*—Bernard J. Murphy

[57] ABSTRACT

The Assembly is formed of individual, radially-fingered plates, set upon a body, in surmounting relationship, and fastened to the body by a central bolt. The Method calls for the provisioning of the body and the radially-fingered plates, setting the plates upon the body, fastening the plates thereon, and bending the fingers, angularly from their plates, into a common parallelism, with the ends of the fingers all terminating in a common plane. The kit sets forth the components for an Assembly: a plurality of radially-fingered plates, a body, and a fastener for fixing the plates onto the body. The Plate is flat, having a uniform thickness, with radially-extending fingers, and apertured in a central portion thereof.

16 Claims, 1 Drawing Sheet

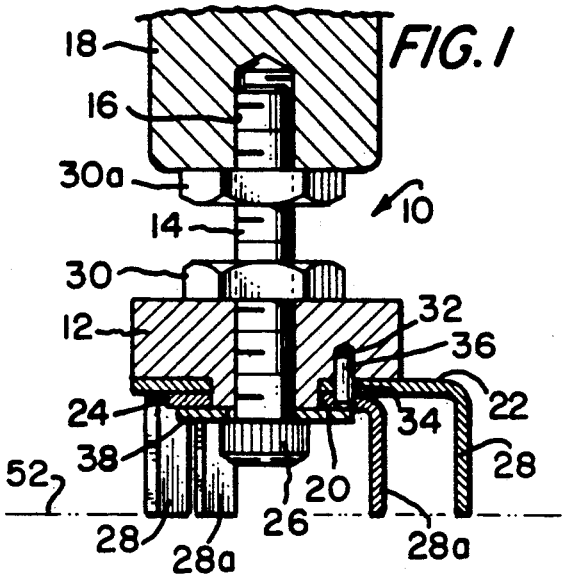
FIG. 1
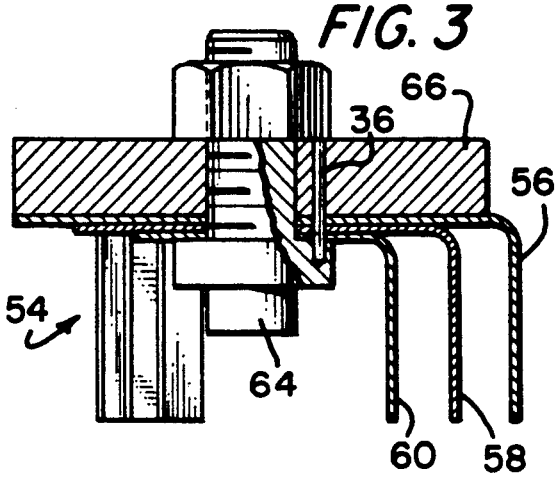
FIG. 3
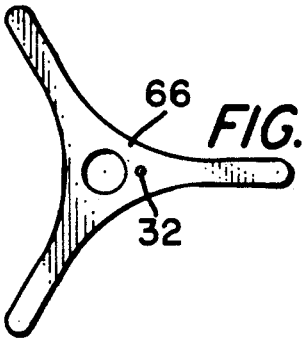
FIG. 4
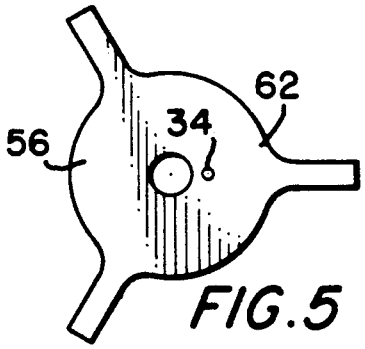
FIG. 5
FIG. 6
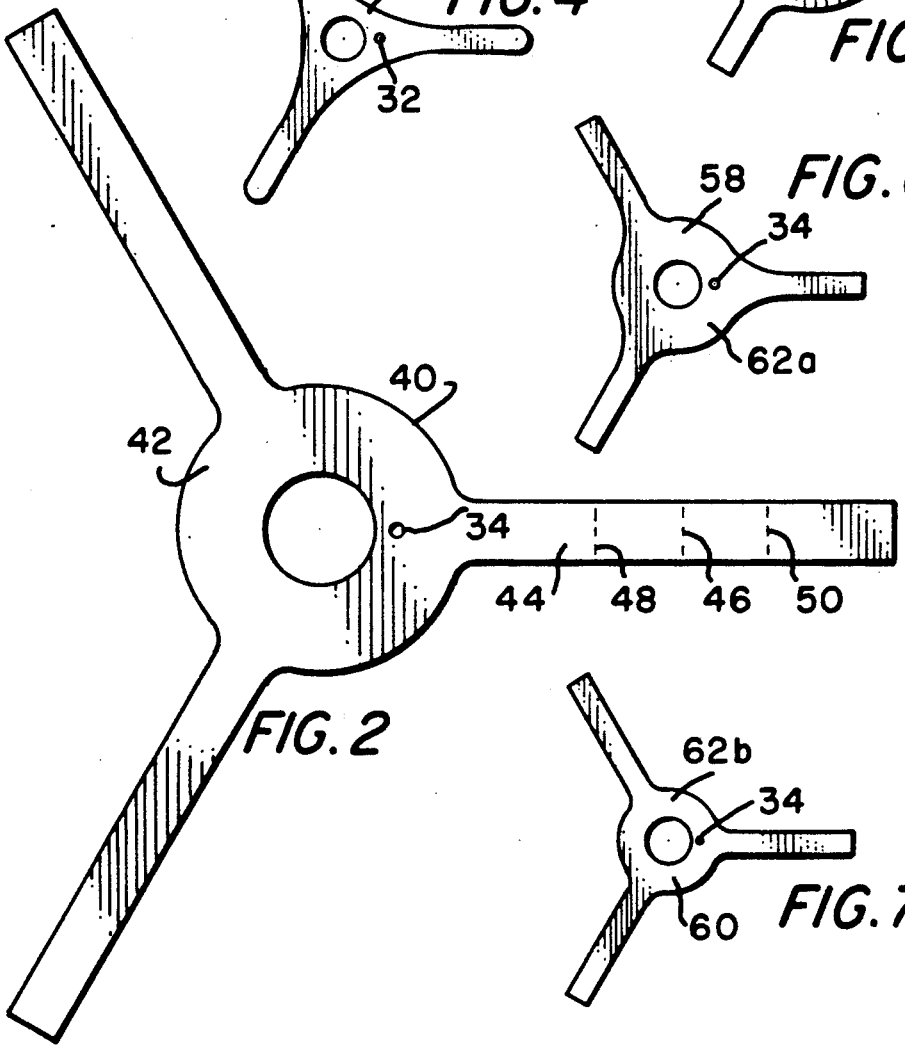
FIG. 2
FIG. 7

VALVE UNLOADER FINGER ASSEMBLY, A METHOD OF FORMING THE SAME, A KIT, AND A PLATE THEREFOR

This invention pertains to valve unloader assemblies, the same comprising mechanisms which hold valves in gas compressors in an open condition when it is desired to operate the compressor unloaded, and in particular to a novel, inexpensive, albeit reliable, unloader finger assembly, a method of forming the assembly, a kit for such assembly, and a plate therefor.

Unloader assemblies, fingered unloader assemblies, are well known in the prior art, and typical thereof is the "unloading fork" disclosed in U.S. Pat. No. 1,769,899, issued in 1 July, 1930, to W. E. Mathews, for a "Compressor Valve". The unloading fork, the same being a fingered component, comprises a casting. Commonly, such fingered unloader assemblies are cast components. However, cast materials are difficult to machine, and they are expensive to manufacture. Consequently, there has been a long unmet need for an inexpensive valve unloader finger assembly, and it is an object of this invention to meet that need.

Specifically, it is an object of this invention to set forth a valve unloader finger assembly comprising a body; and a plurality of plates set upon said body; wherein each of said plates has a plurality of fingers projecting, angularly, therefrom; one of said plates is superimposed upon another thereof; and means holding said plates fast to said body.

It is also an object of this invention to disclose a method of forming a valve unloader finger assembly comprising the steps of providing a body; providing a plurality of radial-fingered plates; setting the plates upon said body with one of said plates superimposed upon another thereof; fastening said plates to said body; and bending said fingers until (a) each is angularly projected from its respective plate, and (b) all said fingers have substantially a common parallelism.

It is a further object of this invention to set forth a valve unloader finger assembly kit comprising a plurality of radially-fingered plates; a body; and a fastener for securing said plates to said body.

It is yet a further object of this invention to disclose a plate, for a valve unloader finger assembly comprising a flat plate, of uniform thickness, having (a) a central portion, and (b) radially extending fingers; and wherein said central portion has an aperture formed therethrough and centrally thereof.

Other objects of this invention, as well as the novel features thereof will become more apparent by reference to the following description, taken in conjunction with the accompanying figures, in which:

FIG. 1 is an axial, cross-sectional view of the novel assembly, according to an embodiment thereof;

FIG. 2 is a plan view of a plate blank useful for forming either one of the fingered plates of the FIG. 1 assembly; it is enlarged considerably;

FIG. 3 is an axial, cross-sectional view of an alternative embodiment of the novel assembly;

FIG. 4 is a plan view of the body of the alternative embodiment; and

FIGS. 5, 6 and 7 are plan views of the plates of the alternative embodiment.

As shown in FIG. 1, the novel assembly 10 comprises a body 12 which is centrally bored and tapped to receive a bolt 14. The terminal end of the bolt 14 is threadedly received in a tapped bore 16 formed in an actuating plunger 18 (of which only a portion is shown). The body 12 has a central, upstanding boss 20, and set upon the body 12, about the boss 20, are a pair of flat plates 22 and 24. Plate 24 is superimposed upon plate 22, and the two are held fast on the body 12 by the head 26 of the bolt 14. Each plate has a plurality of right-angularly extending fingers 28 and 28a. Lock nuts 30 and 30a provide for a precisioned adjustment of the distance, from plunger 18, at which the novel assembly 10 is set. The body 12 has a shallow hole 32 formed therein and the plates 22 and 24 have corresponding holes 34 formed therethrough. The aforesaid holes are provided to receive a locating pin 36. The latter is set into the holes to restrain the plates from rotation relative to the body 12. A washer 38, held in place by the bolt head 26, secures the pin in place.

FIG. 2 depicts a blank of a plate from which, according to an aspect of the invention, both plates 22 and 24 can be formed. Blank 40 has a central portion 42 from which three fingers (in this embodiment) radiate therefrom equidistantly. Bend and cut lines are represented on one of the fingers 44, to illustrate how the same blank 40 is useful for forming each of the plates 22 and 24. To form plate 22, the blank 40 has only to have each of the fingers bent, at substantially a ninety degree angle, at bend line 46. To form plate 24, the blank 40 has to have the fingers bent, to the same aforesaid angle, i.e., right-angularly, at bend line 48, and have the ends thereof cut at cut line 50. The blank 40 has an aperture in the center of portion 42 thereof, to accommodate the boss 20 of the body 12, and has the hole 34 formed therein to receive the locating pin 36. The cut and bend lines 50, 46 and 48 are predetermined, taking into account the common, uniform thickness of the plates 22 and 24, to insure that the fingers, when bent right-angularly, will each terminate in a common plane 52 (FIG. 1).

FIG. 3 depicts an alternative embodiment of the novel assembly. In this assembly 54, specifically configured plates 56, 58 and 60 are incorporated. These plates are shown in FIGS. 5, 6 and 7, respectively. Each thereof has a center portion 62, **62*a* and 62*b*, which is centrally apertured to receive the shank of an assembly bolt 64, and each has the pin hole 34 to receive a same locating pin 36. Whereas the body 12 of the first embodiment of FIG. 1 is simply a circular component, the body 66 of this alternative embodiment, shown in plan view in FIG. 4, has a shape generally conforming to those of the plates 56, 58 and 60** as a means of providing a little more support for the plates which set thereupon.

To form the assembly 54, then, it is only necessary to stock bodies 66 and plates 56, 58 and 60, together with assembly bolts 64 (and a fastening nut therefor) and pins 36, and draw from stock a set of plates, a body upon which to set the plates, pin them together with the body, and fasten them in place. Then it remains only to bend the radially-extending fingers right-angularly into a common parallelism, with the finger ends occupying a common plane.

Kits of the novel assemblies 10 and/or 54 can be stocked and supplied to users by packaging and shipping the required plurality of radial-fingered plates, a body upon which to set them, and a fastener for securing the plates to the body.

Additionally, replacement plates can be carried in stock, in the form of blank 40, and the same drawn therefrom and cut and/or shaped to meet the replacement requirement.

All the plates 22, 24, 56, 58 and 60 are of uniform thickness, and are cut from common, flat plate material; consequently, they are relatively inexpensive, compared to castings or other forms of fabrication.

While I have described my invention in connection with specific embodiments thereof, and a given method of forming the same, it is to be clearly understood that this is done only be way of example, and not as a limitation to the scope of my invention as set forth in the objects thereof, and in the appended claims.

I claim:

1. A valve unloader finger assembly, comprising:

a body; and a plurality of plates set upon said body; wherein each of said plates has a plurality of fingers projecting, angularly, therefrom;

one of said plates is superimposed upon another thereof; and means holding said plates fast to said body; and further including means engaged with said plates and said body for restraining said plates from rotation relative to said body.

2. A valve unloader finger assembly, according to claim 1, wherein: all fingers of said pluralities thereof terminate in a common plane.

3. A valve unloader finger assembly, according to claim 1, wherein:

each plate, of said plurality thereof, has a uniform thickness.

4. A valve unloader finger assembly, according to claim 1, wherein:

all plates of said plurality thereof have a common and uniform thickness.

5. A valve unloader finger assembly, according to claim 1, wherein:

all fingers of said pluralities thereof project from the respective plates thereof, as aforesaid, substantially right angularly.

6. A valve unloader finger assembly, according to claim 1, wherein:

each of said plates has a hole formed therethrough;

said body has a hole formed therein; and said rotation-restraining means comprises a pin in penetration of all of said holes.

7. A valve unloader finger assembly, according to claim 6, wherein:

said holding means comprises means for securing said pin in place in said holes.

8. A method of forming a valve unloader finger assembly, comprising the steps of:

providing a body;

providing a plurality of radial fingered plates;

setting said plates upon said body with one of said plates superimposed upon another thereof;

fastening said plates to said body; and bending said fingers until (a) each is angularly projected from its respective plate, and (b) all said fingers have substantially a common parallelism.

9. A method, according to claim 8, wherein:

said bending step comprises bending all said fingers until each is projected from its respective plate, as aforesaid, substantially right-angularly.

10. A method, according to claim 8, wherein:

said plates-providing step comprises providing plates which have a common and uniform thickness.

11. A method, according to claim 8, wherein:

said bending step comprises bending all said fingers so that all thereof terminate in a common plane.

12. A method, according to claim 8, further including the step of:

pinning said plates to said body to restrain said plates from rotation relative to said body.

13. A valve unloader finger assembly kit, comprising:

a plurality of radial-fingered plates;

a body; and a fastener for securing said plates to said body; wherein each of said plates has a hole formed therethrough;

said body has a hole formed therein; and further including a pin, for penetration of said holes, for restraining said plates from rotation relative to said body.

14. A kit, according to claim 13, wherein:

each plate, of said plurality thereof, has a uniform thickness.

15. A kit, according to claim 13, wherein:

all plates, of said plurality thereof, have a common and uniform thickness.

16. A plate, for a valve unloader finger assembly, comprising:

a flat plate, of uniform thickness, having (a) a central portion, and (b) radially-extending fingers; and wherein said central portion has (a) an aperture formed therethrough and centrally thereof, and (b) a pin hole, formed therethrough, in which to accommodate a locating pin.

* * * * *